US005614591A

United States Patent [19]

Basinger et al.

[11] Patent Number: 5,614,591

[45] Date of Patent: Mar. 25, 1997

[54] PROCESS AND COMPOSITION FOR IMPARTING DURABLE PRESS PROPERTIES TO TEXTILE FABRICS

[75] Inventors: Brent D. Basinger, Concord; R. Keith Zimmerman, Mooresville, both of N.C.

[73] Assignee: The Virkler Company, Charlotte, N.C.

[21] Appl. No.: 356,843

[22] Filed: Dec. 15, 1994

[51] Int. Cl.[6] ..... D06M 13/382; C08L 33/06; C08L 33/20; C08L 61/20

[52] U.S. Cl. ..... 525/163; 8/182; 8/185; 8/186

[58] Field of Search ..... 525/163; 8/182, 8/185, 186

[56] References Cited

U.S. PATENT DOCUMENTS

| | | | |
|---|---|---|---|
| 3,209,010 | 9/1965 | Gagliardi et al. | 548/110 |
| 3,606,993 | 9/1971 | Arthur, Jr. et al. | 8/116 |
| 3,640,675 | 2/1972 | Thomas | 8/115.6 |
| 3,666,400 | 5/1972 | Lofton et al. | 8/115.6 |
| 3,702,231 | 11/1972 | Dale | 8/115.6 |
| 3,731,411 | 5/1973 | Barber et al. | 8/115.6 |
| 3,909,195 | 9/1975 | Machell et al. | 8/115.7 |
| 3,926,550 | 12/1975 | Harris et al. | 8/115.6 |
| 4,303,456 | 12/1981 | Schmuck et al. | 156/78 |
| 4,396,391 | 8/1983 | North | 8/181 |
| 4,401,688 | 8/1983 | Garnett et al. | 427/43.1 |
| 4,524,093 | 6/1985 | Devry | 427/389.9 |
| 5,252,671 | 10/1993 | Pedain et al. | 525/124 |

OTHER PUBLICATIONS

*All You Need to Know About Cotton Finishing*, Sequa Chemicals, Inc., 1991, pp. 1–7.

Swartout, M. W., *Auxiliaries for Resin Finishing Cotton and Cotton Blend Fabrics*, Callaway Chemical Company, Columbus, Georgia, pp. 1–21.

Andrews et al., *Lowering Formaldehyde Release with Polyols, Textile Chemist and Colorist*, vol. 12, No. 11, Nov. 1980, pp. 25–29.

Turner, J.D., *Durable Press Garments*, Cotton Incorporated, Raleigh, NC, pp. 1–24.

*Primary Examiner*—Thomas Hamilton, III

*Attorney, Agent, or Firm*—Bell, Seltzer, Park & Gibson

[57] ABSTRACT

Durable press properties are imparted to a fabric by applying to the fabric an aqueous durable press treatment composition comprising a reactive modified ethylene urea resin, such as dimethylol dihydroxy ethylene urea (DMDHEU), a crosslinking acrylic copolymer derived from butyl acrylate and acrylonitrile and having a glass transition temperature ($T_g$) of −30° C. or lower, and a catalyst. The fabric is dried to a residual moisture content of 10 to 20 percent by weight, is pressed to remove unwanted wrinkles, and is heated at a temperature of 88° to 175° C. for up to fifteen minutes to cure and crosslink the durable press treatment composition and impart durable press properties to the fabric. The process can be applied either to fabrics prior to fabrication into garments, or as a garment durable press process imparting durable press properties to fabricated garments.

17 Claims, No Drawings

PROCESS AND COMPOSITION FOR IMPARTING DURABLE PRESS PROPERTIES TO TEXTILE FABRICS

FIELD OF THE INVENTION

The present invention relates to the durable press treatment of textile fabrics, and more particularly to a durable press treatment process and durable press treatment composition which provides improved durable press performance.

BACKGROUND OF THE INVENTION

Processes for the durable press treatment of textile fabrics were first introduced in the 1960's and have achieved widespread use since that time. These durable press treatment processes typically involve treating the fibers of the textile fabrics with crosslinking agents. Early durable press processes used formaldehyde as a crosslinking agent which, although effective, was highly odorous and undesirable to the consumer. Formaldehyde was replaced by reactive resins such as dimethylol urea (DMU), dimethylol ethylene urea (DMEU), and by modified ethylene urea resins, such as dimethylol dihydroxy ethylene urea (DMDHEU).

While these crosslinking agents are capable of providing a fabric with good wrinkle resistance and crease recovery properties, it has been found that the desired increases in the durable press performance through the use of crosslinking agents are accompanied by undesirable losses in other important fabric properties, such as tensile strength, tear strength, abrasion resistance and fabric hand.

Thus, there has been considerable effort to develop durable press systems which provide a high durable press rating to fabric but not at the expense of the hand, tensile strength, tear strength, and abrasion resistance. Various specialized resin systems, catalysts and buffers have been developed, and a variety of treatment bath additives have been proposed as hand builders, softeners, wetting agents, and formaldehyde scavengers. For example, U.S. Pat. No. 3,926,550 to Harris et al. teaches using tung oil to increase the abrasion resistance of cotton fabric. U.S. Pat. No. 3,666,400 to Lofton et al. discloses a durable press process which combines a durable polymer, such as a polyacrylate polymer, with a temporary polymer and DMDHEU to provide size to the fabric and to increase the abrasion resistance. U.S. Pat. No. 3,731,411 to Barber et al. teaches a copolymer of guanamine and an acrylic such as acrylonitrile, an addition type polymer such as butyl acrylate, and a glyoxal resin which impart durable press properties to cellulosic fabric and which attempt to diminish the loss of strength and abrasion resistance associated with the durable press process.

Despite the solutions proposed by the aforementioned patents and other approaches described in the published literature, there still exists a need for improvements in durable press properties of the fabric while minimizing the negative effects resulting from durable press treatment. Moreover, with the current market demand for natural looking, comfortable 100% cotton wrinkle-resistant garments, there exists a need for an effective durable press treatment process suitable for processing cotton garments in a garment durable press process.

SUMMARY OF THE INVENTION

The present invention provides a durable press process that yields excellent durable press and crease retention ratings while maintaining good strength and abrasion resistance as well as aesthetically pleasing hand properties in the fabric.

Durable press properties are imparted to a fabric by applying to a fabric an aqueous durable press treatment composition comprising a reactive modified ethylene urea resin, a crosslinking acrylic copolymer having a glass transition temperature ($T_g$) of −30° C. or lower, and a catalyst; drying the fabric to a residual moisture content of not below 10 percent by weight; and heating the fabric to cure and crosslink said durable press treatment composition and impart durable press properties to the fabric.

The aqueous durable press treatment composition preferably contains, on a weight percent basis, from 1% to 25% of the modified ethylene urea resin and from 0.5% to 12% of the acrylic polymer. In one particularly suitable embodiment of the invention, the modified ethylene urea resin employed in the treatment composition is dimethylol dihydroxy ethylene urea (DMDHEU) and the crosslinking acrylic copolymer comprises a copolymer derived from butyl acrylate and acrylonitrile and having a glass transition temperature ($T_g$) of −30° C. or lower. In another embodiment, the modified ethylene urea resin is dimethylol urea/glyoxal (DMUG), a formaldehyde-free resin, and the acrylic copolymer comprises a copolymer derived from butyl acrylate and acrylonitrile and having a glass transition temperature ($T_g$) of −30° C. or lower. In addition to the reactive modified ethylene urea resin and crosslinking acrylic copolymer, the aqueous durable press treatment composition of the present invention may also contain a nonionic wetting agent, a softening agent and a catalyst.

The present invention can be effectively practiced as a garment durable press process wherein garments are placed in a treatment vessel and are saturated with the aqueous durable press treatment composition; excess treatment composition is extracted from the garments; the garments are tumble dried with heated air to a residual moisture content of from 10 to 20 percent by weight; and the thus dried garments are pressed to remove unwanted wrinkles and impart desired creases. Afterwards, the thus pressed garments are directed through a heated curing oven at a temperature of 88° to 175° C. for up to fifteen minutes to cure and crosslink the durable press treatment composition and impart durable press properties to the garments. The process may also be applied to fabrics in the form of piece goods of predetermined width and indeterminate length. The treatment composition is applied to the fabric in the conventional manner, such as by padding, followed by heating the fabric on a tenter frame to cure the durable press composition.

These and other features of the present invention will become more readily apparent to those skilled in the art upon consideration of the following detailed description which describes both the preferred and alternative embodiments of the invention.

DETAILED DESCRIPTION OF THE INVENTION

The durable press composition and method of the present invention can be applied in the manner of a conventional precure process wherein the crosslinking durable press composition is applied and cured in the textile finishing mill, or in the manner of a conventional postcure process wherein the durable press composition is applied to the fabric in the textile finishing plant and dried without curing or crosslinking, with the fabric thereafter being made into garments, pressed and cured. However, the present invention is especially useful and advantageous when applied to completed garments. In this type of process, also known in the textile industry as a garment durable press process, the entire durable press process occurs on a completed garment. After the garments are fabricated, they are impregnated with the durable press composition, dried, pressed and cured. One advantage of this type of process is that the completed garment can be pressed into a desired shape before the garment is cured and crosslinked. This is particularly important when pleats or creases are needed in the completed garment. In addition, the garment durable press process results in a fabric with a softer hand than those resulting from other conventional processes. The garment durable press process is popular because it provides better inventory control and provides flexibility for performing dyeing operations or finishing operations, such as stone washing, before durable press treatment.

The process is applicable to fabrics of various fiber compositions, particularly cellulosic fibers and blends of cellulosic fibers and synthetic fibers. Typically, the cellulosic fibers treated by this process are cotton, linen, flax, rayon, lyocell, viscose rayon, or cellulose acetate. However, other natural fibers such as wool, ramie, alpaca, vicuna, mohair, cashmere, guanaco, camel, llama, fur, suede and silk could be subjected to the process. The blends are blends of the above listed fibers with synthetic fibers, typically with polyesters such as polyethylene terephthalate, but potentially with nylon, acrylic fibers such as polyacrylonitrile or homopolymers or copolymers of acrylonitrile. The cellulosic fibers, either alone or in combination with the above listed synthetic fibers are manufactured into a fabric by conventional processes such as weaving or knitting.

The durable press treatment process is carried out by treating the fabric with an aqueous bath containing the durable press treatment composition, typically by placing the fabric, either as piece goods or as garments, in conventional wet processing equipment and adding the bath components. For a precure or postcure process, the composition may be applied, for example, by a conventional pad bath and roller extractor. For a garment durable press process, conventional washer/extractor machines, dip machines or paddle machines can be suitably employed, as is well known to those familiar with this art. Exemplary machines include those offered by Braun, Milnor, Washex and Unimac.

The aqueous durable press treatment bath contains a reactive modified ethylene urea resin, an acrylic copolymer, and a catalyst. Typically, the modified ethylene urea resin is dimethylol dihydroxy ethylene urea (DMDHEU), but other modified ethylene urea resins could be used, such as dimethylol ethylene urea (DMEU) or dimethylol urea/glyoxal (DMUG). The resins are normally used in conjunction with a catalyst to promote crosslinking of the resin with the fibers upon heating. Typically, a Lewis acid such as, for example, magnesium chloride, magnesium nitrate, zinc nitrate, zinc chloride, zinc borofluoride, magnesium biphosphate, ammonium chloride, aluminum chloride, and the like is utilized. Other catawlysts which can provide the necessary bath pH without damaging the fabric or the bath components can also be used. Suitable comercially available modified ethylene urea resins are often supplied in a pre-catalyzed and/or pre-buffered form.

The amount of modified ethylene urea resin used in the treatment composition may range from 1 to 25 percent by weight of the bath, based upon the amount of active resin the specific amount used is dependent upon a number of factors, including the basis weight of the fabric, e.g. shirting fabric or bottom-weight (i.e. trouser) fabric, the fiber content, the particular modified ethylene urea resin used, and the other materials present in the treatment composition. For treatment compositions using DMDHEU as the modified ethylene urea resin, the resin content preferably ranges from about 1 to about 7 percent by weight. When DMEU is used, the resin content is preferably 2 to 15 percent by weight. When DMUG is used, the resin content is preferably 1 to 15 percent by weight.

The treatment composition also contains an acrylic copolymer with a glass transition temperature ($T_g$) of less than or equal to −30° C. A preferred acrylic copolymer used in the process is derived from polyacrylate monomers and acrylonitrile monomers. The polyacrylate monomer which forms the acrylic copolymer typically is butyl acrylate, but could include methyl acrylate, ethyl acrylate, propyl acrylate, and/or other alkyl acrylates. Particularly preferred is a self-crosslinking acrylic copolymer derived from butyl acrylate and acrylonitrile and having a glass transition temperature ($T_g$) of −30° C. or lower. Generally, the copolymer is derived from a greater amount of the butyl acrylate monomer than acrylonitrile monomer. This acrylic copolymer combines the soft qualities of a polyacrylate homopolymer with the hard qualities of an acrylonitrile homopolymer to form a copolymer which, when used in combination with the modified ethylene urea resin, contributes a unique combination of tensile loss reduction, improvements in crease retention and durable press rating, while maintaining desirable soft fabric tactile (hand) properties. The acrylic copolymer is preferably present in the aqueous durable press composition at from 0.5 to 12 weight percent of the bath, based upon the solids content of the resin. Acrylic copolymers of this type are manufactured by various manufacturers including Rohm and Haas Company and National Starch and Chemical Company.

The aqueous durable press composition may further include one or more additives selected from the group of buffering agents, wetting agents, softening agents, and formaldehyde scavengers. Buffering agents help control the acidity of the bath and help reduce tendering of the fabric. Typical buffering agents include citric acid, sodium citrate, acetic acid, sodium acetate, hydroxy acetic acid, sodium hydroxy acetate, monochloroacetic acid, sodium monodichloro acetate and mixtures of the above.

Wetting agents allow the fabric to more readily absorb the bath components thus streamlining the durable press process. Exemplary wetting agents include soaps, alcohols, fatty acids, and any other agents which facilitate the absorbance of the aqueous components into the treated fabric. For examples of well-known wetting agents which may be useful in the present invention, reference may be made to *Surface Active Agents and Detergents*, Vol. I and II by Schwartz, Perry and Birch; and to Boskamp U.S. Pat. No. 4,465,619, column 2, lines 3–5. Particularly preferred are nonionic wetting agents such as alkyl phenol ethoxylates (APE), linear alcohol ethoxylates (LAE), and fatty acid ethoxylates (FAE).

The composition will generally include softening agents to improve the hand of the fabric. The amount of softening agent applied to the bath is dependent on the hand properties desired for the fabric and the fabric substrate that is to be treated by the process. Typical softeners include high-density cationic polyethylene emulsions, as well as low-density emulsions and anionic and nonionic emulsions depending on the fabric used and the preferred hand. Other softening agents such as silicone softeners (e.g. reactive polysiloxane compounds), alkyl sulfates, fatty acid condensation products, N-methylol compounds of the higher fatty acid amides, N-methylol compounds of urea substituted with higher fatty acids, methylol stearic amides, quaternary ammonium salts, amino esters, amino amides, polyoxyalkene glycols, polyglycol ethers and esters, and water-soluble polyethers may also be used.

Formaldehyde scavengers can also be added to the aqueous bath to remove the free formaldehyde which forms in the treatment process. Commonly used scavengers include amides, urea, ethylene urea, sodium bisulfite, sodium borohydride, phthalimide, and polyhydroxy alcohols (i.e. alcohols that contain more than one alcohol group per unit molecule).

The combination of these components, when used, results in a synergistic effect in which the fabric not only maintains good tensile strength, hand, and abrasion resistance but also provides durable press ratings of 4.0 and greater (AATCC Test Method No. 124) and crease retention ratings of between 4.0 and 5.0 (AATCC Test Method No. 88C). Although it is not fully understood why the above described combination of components results in durable press properties that so greatly surmount those achieved previously in the art, the combination described in the present invention provides these results on a consistent basis and any deviation from the above description can result in decreased durable press ratings, crease retention ratings, hand, strength, and/or abrasion resistance.

Garments are preferably treated with the aqueous durable press composition for a period of approximately ten minutes. The garments are then extracted until they contain preferably from 50% to 80% wet pick-up. The garments are then placed in a tumble dryer or any other machine which can effectively dry the garments at a low enough temperature to prevent premature curing of the durable press composition. Typically, tumble drying is preferred because it results in uniform drying, uniform distribution of the composition on the fabric, and a softer hand. Preferably, the fabric is dried until the residual moisture content is between 10% and 20%. It is important that the fabric not be overdried.

The subsequent step in the durable press process is the pressing or ironing of the fabric. Pressing results in the removal of unwanted wrinkles. Generally, fabric is pressed flat to remove all wrinkles which might exist in the fabric. Often, when creases are desirable such as in the case of pleats and the like, creases may be pressed into the fabric or completed garment. Typically, any steam or electric press can be used to provide the desired wrinkle removal (or crease addition) in the fabric.

The pressed fabric or garment is heated to cure and crosslink the acrylic copolymer and the modified ethylene urea resin to the fibers of the fabric. The curing and crosslinking can be in any suitable device, such as a tumble dryer or heated oven. The fabric is heated at a temperature of 88° to 175° C. for up to fifteen minutes. Preferably, the curing and crosslinking is carried out by directing the pressed garments through a heated curing oven at a temperature of about 143° to 157° C. for three to fifteen minutes and desirably for between 3 and 6 minutes, depending on the characteristics of the particular oven. The short cure time necessary for effective crosslinking reduces the possibility of fabric damage from overcuring and is economically efficient because it limits the energy costs associated with treating the fabric. The choice of the time and temperature for heat curing of the fabric depends on the fabric construction, fabric weight, and the amount and type of bath components used in the treatment process. Generally, any time and temperature is suitable which does not result in wrinkling or distortion of the fabric or garment and which does not cause the degradation of the fibers. Generally, hot-air ovens such as the curing ovens available from Sussman-Automatic Corporation of New York, U.S.A. and Ducker Engineering of the United Kingdom are appropriate for curing the fabric. Other ovens or heating devices can be also be used to cure and crosslink the bath components to the fabric.

The following examples provide a greater understanding into the advantages of the present invention.

EXAMPLE 1

A 100 pound load of 100 percent cotton men's shirts was placed in a commercial front loading washer/extractor machine and the machine was filled with water to the desired level. The following components were then added to the machine (all percentages are by weight, based on the total actives or solids):

5.5% buffered, precatalyzed DMDHEU resin 1.0% nonionic polyethylene/silicone softener 0.25% nonionic wetting agent 4.0% butyl acrylate/acrylonitrile copolymer ($T_g$–42° C.)

The garments were agitated in the bath for ten minutes. The bath was drained from the machine, and the garments were extracted to about 75% wet pick-up. The garments were removed from the machine, placed in a tumble drier, and tumble dried in heated air at 60° C. until they had a residual moisture content of 15% to 20%. The garments were removed from the tumble dryer and pressed with a heated iron to remove wrinkles. The pressed garments were then placed hanging in a heated curing oven at 149° C. (300° F.) for six minutes.

EXAMPLE 2

Identical samples of 100 percent cotton twill weave fabric were impregnated with aqueous treatment baths of various compositions and were dried, pressed and cured under identical conditions, generally similar to those described in Example 1. The various treatment baths, described in Table 1, included compositions in accordance with the present invention, comparative compositions not in accordance with the invention, and controls. The appearance properties of the fabric samples were measured and compared. The durable press rating (DP) of the samples was determined using AATCC Standard Test Method 124. The crease retention rating (CR) was determined using AATCC Standard Test Method 88C. The percent tensile loss of the fabric samples was also measured using an AATCC approved Scott Tester and compared to that of an untreated control sample.

It is understood that upon reading the above description of the present invention, one skilled in the art could make changes and variations therefrom. These changes and variations are included in the spirit and scope of the following appended claims.

That which is claimed:

1. A process for imparting durable press properties to a fabric comprising:

impregnating a fabric with an aqueous durable press treatment composition comprising a reactive modified ethylene urea resin, a crosslinking acrylic copolymer having a glass transition temperature ($T_g$) of –30° C. or lower, and a catalyst;

drying the fabric to a residual moisture content of not below 10 percent by weight;

removing wrinkles from the fabric; and heating the fabric with the wrinkles thus removed to cure and crosslink said durable press treatment composition and impart durable press properties to said fabric.

2. The process according to claim 1 wherein said fabric is in the form of garments and said step of removing wrinkles is performed between said drying and heating steps and comprises pressing the fabric to remove unwanted wrinkles.

3. The process according to claim 1 wherein said fabric is in the form of piece goods of predetermined width and indeterminate length, and said step of removing wrinkles comprises tentering the fabric.

4. The process according to claim 1 wherein said aqueous composition contains from 1% to 25% by weight of said modified ethylene urea resin and from 0.5% to 12% of said acrylic polymer per weight of said aqueous composition.

5. The process according to claim 1 wherein said modified ethylene urea resin is dimethylol dihydroxy ethylene urea (DMDHEU).

6. The process according to claim 1 wherein said modified ethylene urea resin is dimethylol ethylene urea (DMEU).

7. The process according to claim 1 wherein said modified ethylene urea resin is dimethylol urea/glyoxal (DMUG).

8. The process according to claim 1 wherein said crosslinking acrylic copolymer comprises a copolymer derived from butyl acrylate and acrylonitrile and has a glass transition temperature ($T_g$) of −30° C. or lower.

9. The process according to claim 1 wherein said aqueous durable press treatment composition also comprises one or more additives selected from the group consisting of buffering agents, wetting agents, softening agents and formaldehyde scavengers.

10. A process for imparting durable press properties to a fabric comprising:

impregnating a fabric with an aqueous durable press treatment composition comprising a dimethylol dihydroxy ethylene urea (DMDHEU) resin, a crosslinking acrylic copolymer derived from butyl acrylate and acrylonitrile and having a glass transition temperature ($T_g$) of −30° C. or lower, and a catalyst;

extracting excess treatment composition from the fabric;

drying the fabric to a residual moisture content of from 10 to 20 percent by weight;

removing wrinkles from the fabric; and heating the fabric with the wrinkles thus removed at a temperature of 88° to 175° C. for up to fifteen minutes to cure and crosslink said durable press treatment composition and impart durable press properties to the fabric.

11. The process according to claim 10 wherein said fabric is in the form of garments and said step of removing wrinkles is performed between said drying and heating steps and comprises pressing the fabric to remove unwanted wrinkles.

12. The process according to claim 10 wherein said fabric is in the form of piece goods of predetermined width and indeterminate length, and said step of removing wrinkles comprises tentering the fabric.

13. A process according to claim 10 wherein said heating step comprises directing the fabric through a heated oven at a temperature of 143° to 157° C. for three to fifteen minutes.

14. A process for imparting durable press properties to garments comprising:

placing garments in a treatment vessel and saturating the garments with an aqueous durable press treatment composition comprising a dimethylol dihydroxy ethylene urea (DMDHEU) resin, a crosslinking acrylic copolymer derived from butyl acrylate and acrylonitrile and having a glass transition temperature ($T_g$) of −30° C. or lower, a nonionic wetting agent, a softening agent and a catalyst;

extracting excess treatment composition from the garments;

tumble drying the garments with heated air to a residual moisture content of from 10 to 20 percent by weight;

pressing the thus dried garments with a heated iron to remove unwanted wrinkles and impart desired creases; and directing the thus pressed garments through a heated curing oven at a temperature of 88° to 175° C. for up to fifteen minutes to cure and crosslink said durable press treatment composition and impart durable press properties to the garments.

15. A durable press fabric produced by the process according to claim 1.

16. A durable press fabric produced by the process according to claim 10.

17. A durable press garment produced by the process according to claim 14.

* * * * *

UNITED STATES PATENT AND TRADEMARK OFFICE

CERTIFICATE OF CORRECTION

PATENT NO. : 5,614,591

DATED : March 25, 1997

INVENTOR(S) : Brent D. Basinger et al.

It is certified that error appears in the above-identified patent and that said Letters Patent is hereby corrected as shown below:

Column 3, line 58, "catawlysts" should be --catalysts--.

Column 3, line 65, "resin the" should be --resin. The--.

UNITED STATES PATENT AND TRADEMARK OFFICE

CERTIFICATE OF CORRECTION

PATENT NO. : 5,614,591 Page 2 of 2

DATED : March 25, 1997

INVENTOR(S) : Brent D. Basinger et al.

It is certified that error appears in the above-identified patent and that said Letters Patent is hereby corrected as shown below:

Column 6, after line 54 and before line 55, the following table is missing and should be inserted:

| Components | % owb | DP | CR | Tensile warp | Tensile fill |
|---|---|---|---|---|---|
| THE INVENTION: | | | | | |
| DMDHEU<br>butyl acrylate - acrylonitrile copolymer ($T_g$ -42°C) | 5<br>4 | 4.0 | 5 | 71.3 | 53.8 |
| DMEU<br>$MgCl_2$ catalyst<br>butyl acrylate - acrylonitrile copolymer ($T_g$ -42°C) | 5<br>1.2<br>4 | 4.0 | 5 | 39.0 | 43.1 |
| CONTROL | | | | | |
| Untreated fabric | -- | 1.0 | 2 | -- | -- |
| DMDHEU | 5 | 3.0 | 5 | 72.8 | 53.8 |
| butyl acrylate - acrylonitrile copolymer (Tg -42°C) | 4 | 2.0 | 4 | 23.9 | 9.2 |

Signed and Sealed this

Twenty-first Day of October 1997

*Attest:*

*Attesting Officer*

BRUCE LEHMAN

*Commissioner of Patents and Trademarks*